US008464414B2

(12) United States Patent
Gutierrez

(10) Patent No.: US 8,464,414 B2
(45) Date of Patent: Jun. 18, 2013

(54) VEHICLE MOTOR MOUNTING TOOL

(76) Inventor: Lorenzo R. Gutierrez, Grandview, TX (US)

( * ) Notice: Subject to any disclaimer, the term of this patent is extended or adjusted under 35 U.S.C. 154(b) by 753 days.

(21) Appl. No.: 12/589,825

(22) Filed: Mar. 9, 2010

(65) Prior Publication Data

US 2011/0219598 A1 Sep. 15, 2011

(51) Int. Cl.
*B21D 39/03* (2006.01)

(52) U.S. Cl.
USPC ..... 29/428; 29/244; 29/525.01; 29/592; 29/559; 29/282; 269/131; 254/264; 254/4 R; 254/371; 254/372; 414/287; 414/564; 414/592; 414/787; 294/74; 294/187; 294/76; 294/81.1

(58) Field of Classification Search
USPC ..... 29/428, 592, 527.1, 525.01, 525.02, 29/559, 244–282; 269/131; 294/74, 187, 294/76, 81.1, 67.1, 68.1, 82.1, 68.3, 86.11, 294/86.4, 215; 254/264, 4 R, 371, 372; 414/287, 414/564, 592, 787
See application file for complete search history.

(56) References Cited

U.S. PATENT DOCUMENTS 2,650,055 A * 8/1953 Perkins ..... 248/219.4
2,672,230 A * 3/1954 Jetzke ..... 198/682
2,883,821 A * 4/1959 Enders ..... 57/10
5,800,000 A * 9/1998 Shockley ..... 294/81.3
5,983,615 A * 11/1999 Schmid et al. ..... 56/208

* cited by examiner

*Primary Examiner* — Peter DungBa Vo
*Assistant Examiner* — Azm Parvez

(57) ABSTRACT

A vertical mounted motor hoist and a method of hoisting a motor are provided. The motor hoist includes a threaded eye bolt for lifting the motor hoist; a sleeve threaded inside one end, and attached and held to the threaded eyebolt by means of a threaded plug and dowel pins and welding; and two safety chains for placement around the motor, each safety chain attachable to the sleeve by means of two oppositely positioned pinch bolts, each pinch bolt having a welded nut welded on to the sleeve and a jam nut tightened against the welded nuts.

2 Claims, 3 Drawing Sheets

VEHICLE MOTOR MOUNTING TOOL

HISTORY FOR INSTALLING VERTICAL MOUNTED ELECTRIC MOTORS

The former and present method for installing vertical mounted electrical motors is by tying chains, nylon straps or steel cables around the motor and balancing the motor in a way that the motor will be perfectly straight up and down. By doing this the motor is then lifted to its proper mounting place with the plate with the bolt holes on the motor and the holes on the plate on the frame of the stationary unit being perfectly aligned with each other. By using this method, the person doing the service has no problem inserting the bolts that hold the two mounting plates together. However, this manner of installation is sometimes very difficult because the motor might turn sideways or is not being lifted in a level position with the shaft or the bottom of the motor laying back in an awkward position. As it has been in the past and at the present, this way of mounting such motors has taken several persons to do the job. Usually, it takes two people at the bottom and two people at the top of the surfaces on which the unit is to be mounted. Also, depending on the size of the motor, more assistants may be required. Another disadvantage is that by raising the motors using the tie around mode, the motor has sometimes slipped between the wraps and fell down to the surface below damaging the motor and sometimes causing injuring or damage to personnel and structures below. I believe that the claim that I am presenting is a much safer, more economic and a much simpler way to remove and install these motors and is a much better and easier way to perfectly align both the motor and frame and a guaranteed easy way to insert all the mounting bolts and safely secure both units.

DESCRIPTION

The lifting tool is easy to make. But to guarantee its strength and safety, it should not be manufactured by an inexperienced individual. Those companies, business or private contractors that use this tool, should use those made by manufacturers who are legally authorized to produce these. Those manufacturers are required to use the right parts and specifications. Using homemade copies of this tool could cause harmful injury to individuals and/or serious damage to property.

This tool consists of very few parts with the purpose of each part to be made with maximum precision, strength and durability.

ADVANTAGES FOR USING THE MOTOR HOIST

By using this tool properly, it should take no more than two persons to completely remove and reinstall a unit.

The removal and reinstallation should take only a minimal amount of time. By guaranteeing the use of this tool properly it will be much safer than the wrap around method being used now. Because the tool is very simple to make using some ready made parts and small amounts of welding, the price should be very inexpensive.

Parts for Lifting Tool

Figure 1:
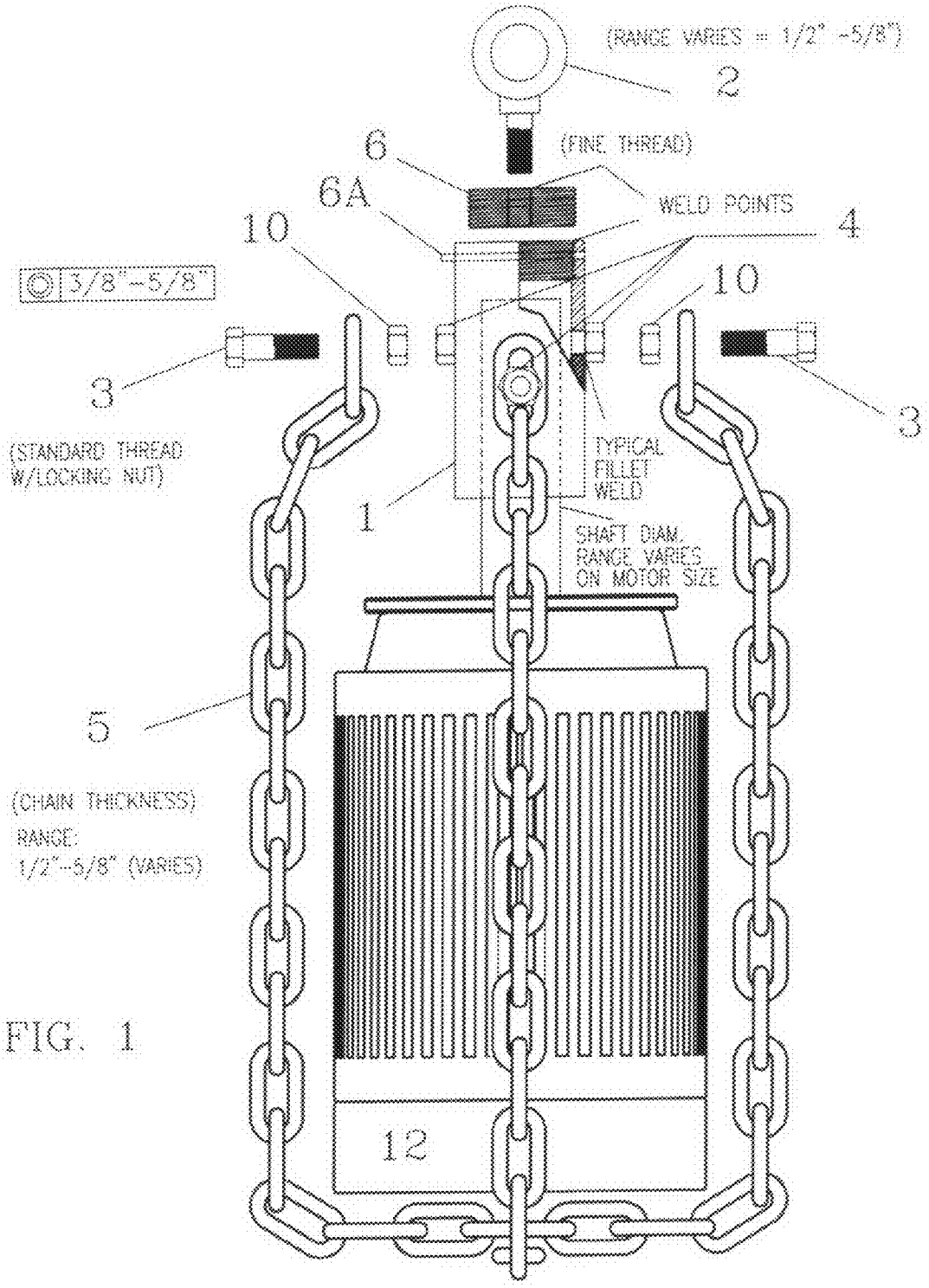
FIG. 1 is an exploded view of the vertical mounted motor hoist.
Figure 2A:
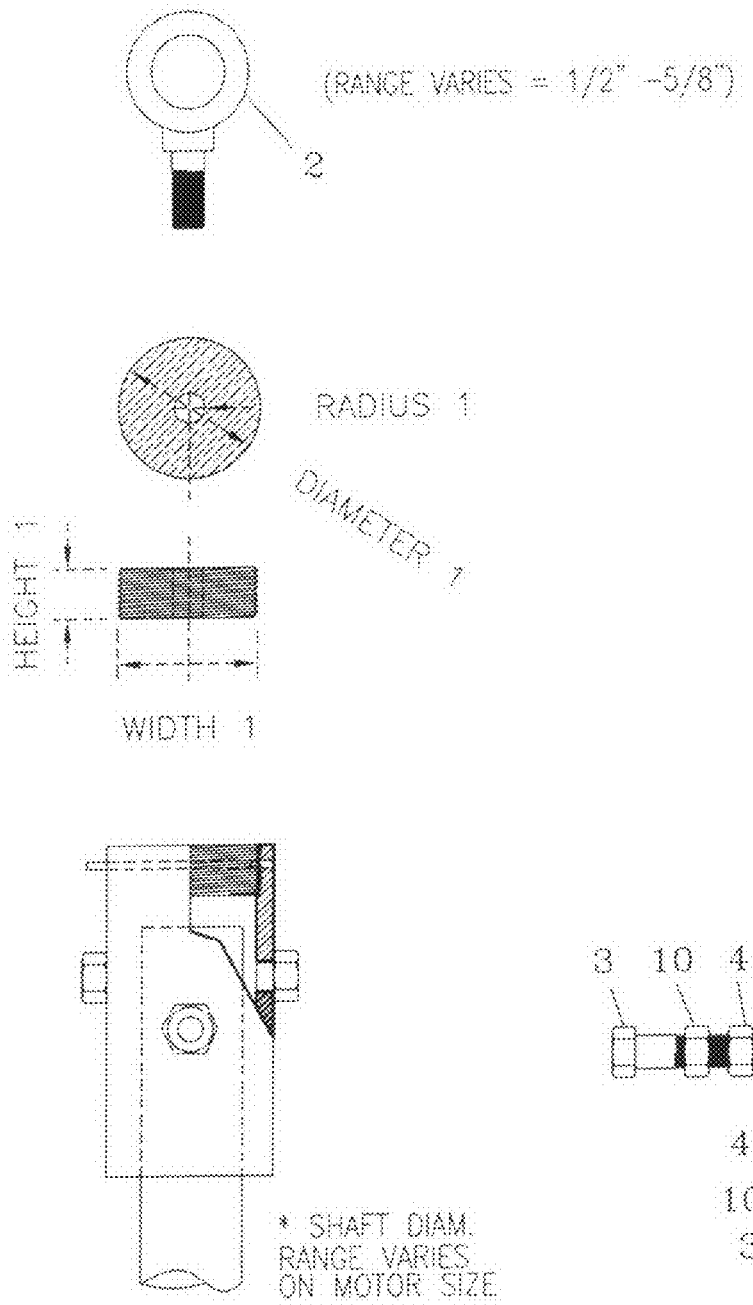
FIG. 2A shows an exploded side view of sleeve and eye bolt used in the invention.
Figure 2B:
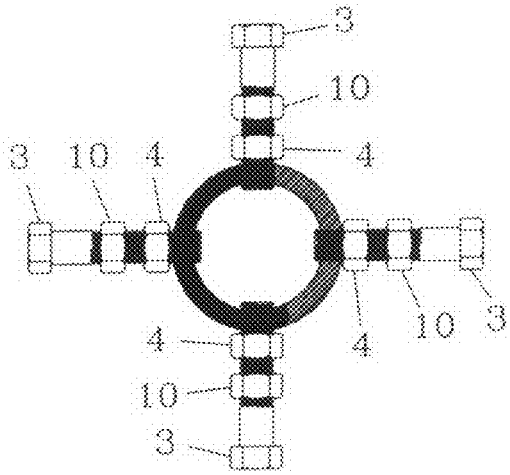
FIG. 2B shows a top view of the sleeve and jam nuts.
Figure 3:
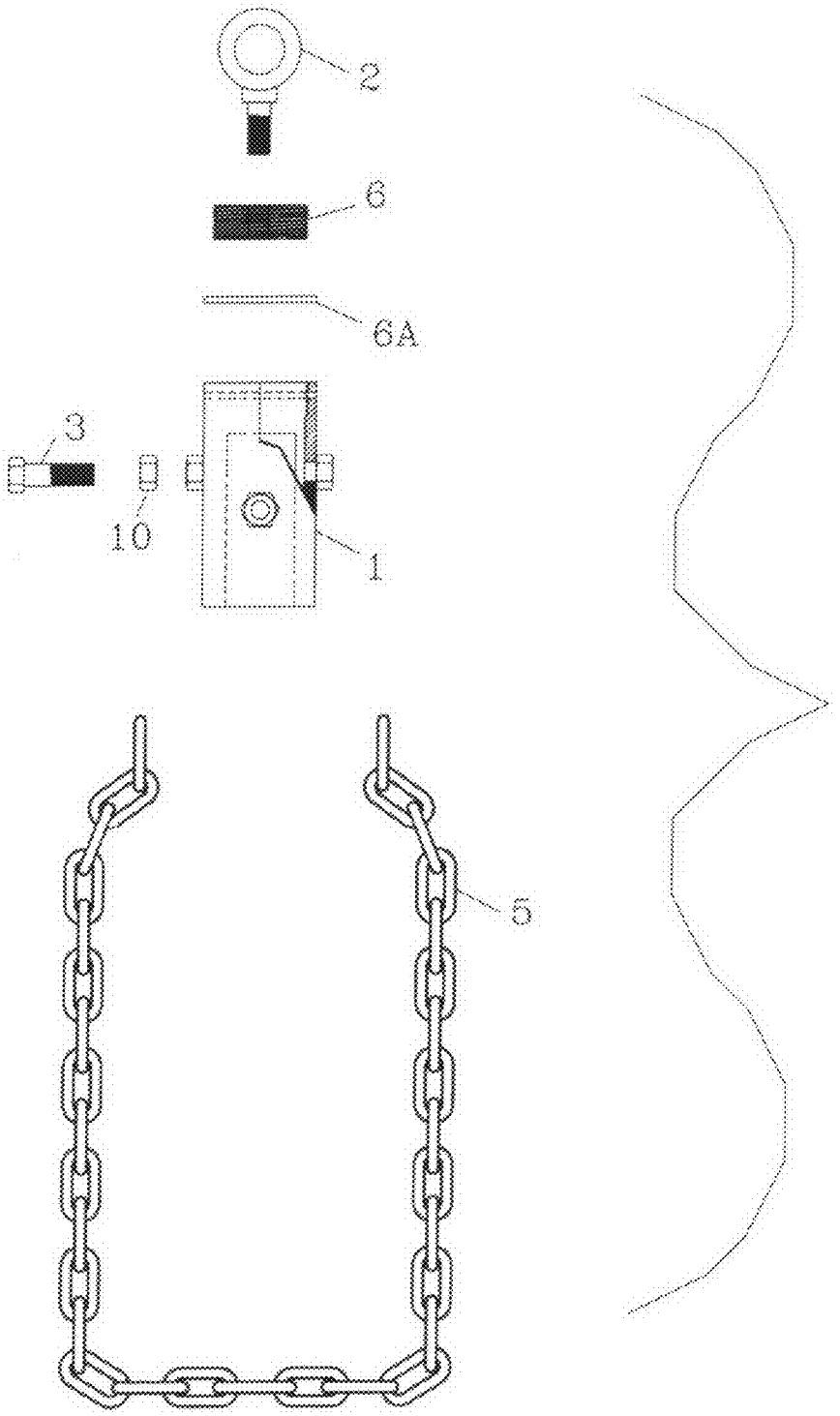
FIG. 3(A-G) shows the separate parts used in the vertical mounted motor hoist.

The parts for this tool are few and simple as shown in FIGS. 1-3. Keep in mind, that larger motors will take larger and stronger tools. Therefore, this is the reason for the drawings and parts information not having any said dimensions or sizes. For example, the sleeve which is the main body of the tool can be made of a one inch I.D. (1" I.D.) schedule forty pipe to as large as a two inch I.D. (2" I.D.) schedule forty pipe. Each one of these sizes should be able to lift motors of five to twenty horsepower and the larger from twenty to fifty horse power, etc.

The bolts, nuts, chains and eye bolt should also differ in sizes, probably from ⅜" to ⅝". As shown in FIGS. 1-3, the invention includes the following components:

1. The sleeve 1, the main body of the tool.
2. The eye bolt 2, the main lifting point. The interior radius of the sleeve shown in FIG. 2A is dependent on the size of the eye bolt 2.
3. The plug 6, a round half inch thick piece of metal drilled and threaded at the center to fit the threads on the eye bolt 2, and threaded around the outside to fit the threaded top of the inside of the sleeve 1 (FIG. 2A).
4. A dowel pin 6A drilled and inserted through the plug 6 and the eye bolt 2 for maximum strength.
5. Four holes (sized varying) drilled and tapped on the sleeve 1 (shown in the Figures where pinch bolts 3 are inserted in sleeve 1), with two facing each other and two at different levels. The purpose for this is to hold the shaft at two different points for maximum strength.
6. Pinch bolts 3, four bolts (sizes varying) screwed into the threaded holes in the sleeve 1.
7. Four welded nuts 4, four nuts (sizes varying) welded onto the sleeve 1 to give the pinch bolts 3 more strength and holding capacity.
8. Four jam nuts 10, four loose nuts tightened against the welded nuts 4, once the pinch bolts 3 are tightened these will keep the pinch bolts 3 from loosening and releasing the grip on the shaft 1.
9. Safety chains 5, two chains (sizes varying) inserted on one end through each pinch bolt 3 between the head of the bolt and the jam nut 10. The loose ends should have a clip type hook (not shown) or chain link for easy on and off. The purpose for this is for easy removal once the unit is properly secured in its place of operation.

Tool Manufacturer's Assembly

As shown in FIGS. 1-3, the vertical mounted motor hoist of the invention is assembled and used as follows:

The eye bolt 2 should be screwed into the center of the plug 6 and welded around the edge for maximum strength.

The plug 6 should be screwed to the threaded inside part of the sleeve 1 and welded around the edge.

Once the eye bolt 2 and the plug 6 are securely threaded or installed, the dowel pin 6A needs to be drilled and inserted through both the plug 6 and the eye bolt 2. All these points will make the lifting point securely stable and strong enough to keep anything from stripping, slipping and falling.

The sleeve assembly 1 should have four drilled and tapped holes, two facing each other and two at different levels with the four pinch bolts 3 screwed in these holes (shown where pinch bolts 3 are inserted), one nut 4 on each should also be fitted and tightened against the outside wall of the sleeve and welded.

Pinch bolts 3: these four bolts should be slipped first through one end of each safety chain 5 and then the jam nut 10 screwed on and the bolts 3 screwed into the nuts 10 and threaded holes in the wall of the sleeve 1.

The jam nuts 10: these four nuts should be fitted loosely on the pinch bolts 3 after the safety chains 5. Once the pinch bolts 3 are tightened against the shaft of the motor 12, the jam nuts 10 should be tightened against the welded nuts 4.

Safety chains 5: these two chains should be slipped on one end, and before the jam nuts 10, on the slick part of the bolt shaft 3 as shown in FIG. 1. The opposite end of the chain 5 should have a clip on chain link for easy on and off purposes (not shown). These two chains 5 must fit loosely around the bottom of the motor 12 (motors) forming a net or cage under the motor 12 to help catch it in case the shaft slips off the pinch bolts 3.

What is claimed is:

1. A vertical motor mounting tool for hoisting and installing a motor, comprising:

a) a threaded eye bolt for lifting the motor, said eye bolt having a lower threaded plug;

b) an annular sleeve having a threaded inner upper portion to be attached to said lower threaded plug of said eye bolt, said sleeve attached and held to the threaded eye-bolt by means of said threaded plug, dowel pins and welding; said sleeve further having a plural of nuts welded on the opposite positions of the outer surface of said sleeve; and c) two safety chains for placement around the motor, each safety chain removably connected at its ends to the sleeve by means of two oppositely positioned pinch bolts, each pinch bolt fastened to each of said nuts welded to the sleeve; each of said pinch bolts further engage with and a jam nut tightened against the welded nuts.

2. A method of hoisting and installing a motor at a location, comprising:

a) providing a vertical motor mounting tool according to claim 1;

b) placing the two safety chains around said motor and attaching the safety chains to the sleeve by the pinch bolts;

c) hoisting the motor hoist and motor by the threaded eye bolt to the location; and d) installing the motor at the location.

* * * * *